US011308742B2

(12) United States Patent
Jonsson et al.

(10) Patent No.: US 11,308,742 B2
(45) Date of Patent: Apr. 19, 2022

(54) ELECTRONIC LOCK WITH SLOT ANTENNA

(71) Applicant: ASSA ABLOY AB, Stockholm (SE)

(72) Inventors: Tomas Jonsson, Rönninge (SE); Mats Cederblad, Hässelby (SE); Peter Kjellqvist, Mölnbo (SE); Pär Berglund, Vallentuna (SE)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 16/961,891

(22) PCT Filed: Dec. 18, 2018

(86) PCT No.: PCT/EP2018/085616
§ 371 (c)(1),
(2) Date: Jul. 13, 2020

(87) PCT Pub. No.: WO2019/141469
PCT Pub. Date: Jul. 25, 2019

(65) Prior Publication Data

US 2020/0372737 A1 Nov. 26, 2020

(30) Foreign Application Priority Data

Jan. 22, 2018 (EP) ..... 18152786

(51) Int. Cl.
*G07C 9/00* (2020.01)
*G08C 17/02* (2006.01)
(Continued)

(52) U.S. Cl.
CPC ..... *G07C 9/00309* (2013.01); *G07C 9/00944* (2013.01); *G08C 17/02* (2013.01); *H01Q 1/2208* (2013.01); *H01Q 13/18* (2013.01)

(58) Field of Classification Search
CPC ..... G07C 9/00309; G07C 9/00944; G07C 2009/00793; G08C 17/02; H01Q 1/2208; H01Q 13/10; H01Q 13/18; H01Q 1/40
(Continued)

(56) References Cited

U.S. PATENT DOCUMENTS 5,767,789 A * 6/1998 Afzali-Ardakani ..... G06K 7/10178 340/10.1
6,304,168 B1 10/2001 Ohta et al.
(Continued)

FOREIGN PATENT DOCUMENTS

CN 2667093 12/2004
CN 101189402 5/2008
(Continued)

OTHER PUBLICATIONS

Bengang "Design of complete synchronization digital Frequency Meter based on FPGA," Hunan University, Aug. 2007, Thesis submitted in partial satisfaction of the Requirements for the degree of College teachers in Circuits and Systems in the Graduate School of Hunan University, 38 pages.
(Continued)

*Primary Examiner* — Edwin C Holloway, III
(74) *Attorney, Agent, or Firm* — Sheridan Ross P.C.

(57) ABSTRACT

It is provided an electronic lock for selectively locking a barrier to a surrounding structure. The electronic lock comprises: a locking bolt, a housing comprising metallic material, wherein the housing comprises a through-hole through which the locking bolt can pass; and a wireless communication module. The housing comprises a cut-out forming a slot antenna, wherein the wireless communication module is connected to the housing and thus the slot antenna. The slot
(Continued)

antenna is formed on the same surface of the housing through which the locking bolt can pass.

11 Claims, 2 Drawing Sheets

(51) Int. Cl.
*H01Q 13/18* (2006.01)
*H01Q 1/22* (2006.01)

(58) Field of Classification Search
USPC ..... 340/5.64
See application file for complete search history.

(56) References Cited

U.S. PATENT DOCUMENTS

| | | | | |
|---|---|---|---|---|
| 2012/0006083 | A1 | 1/2012 | Sasaki | |
| 2013/0241694 | A1* | 9/2013 | Sharma | G08C 17/02 340/5.64 |
| 2016/0017640 | A1* | 1/2016 | Soloway | E05B 63/08 70/91 |
| 2018/0160835 | A1* | 6/2018 | Garrity | G07F 17/12 |
| 2019/0089185 | A1* | 3/2019 | Zhang | H02J 50/20 |

FOREIGN PATENT DOCUMENTS

| | | |
|---|---|---|
| CN | 101312264 | 11/2008 |
| CN | 102124177 | 7/2011 |
| CN | 104092009 | 10/2014 |
| CN | 104319456 | 1/2015 |
| CN | 107394392 | 11/2017 |
| CN | 206815988 | 12/2017 |
| CN | 206859854 | 1/2018 |
| EP | 2998470 | 3/2016 |
| GB | 2344201 | 5/2000 |
| JP | H07-62940 | 3/1995 |
| JP | 2004-129010 | 4/2004 |

OTHER PUBLICATIONS

Official Action with English Translation for China Patent Application No. 201880086480.4, dated Dec. 1, 2020, 13 pages.
Extended Search Report for European Patent Application No. 18152786.2, dated Jul. 9, 2018, 8pages.
International Search Report and Written Opinion for International (PCT) Patent Application No. PCT/EP2018/085616, dated Mar. 18, 2019, 13 pages.
Notice of Allowance with English Translation for China Patent Application No. 201880086480.4, dated May 7, 2021, 8 pages.
Official Action for European Patent Application No. 18819130.8, dated Sep. 13, 2021, 6 pages.

* cited by examiner

ELECTRONIC LOCK WITH SLOT ANTENNA

CROSS REFERENCE TO RELATED APPLICATIONS

This application is a national stage application under 35 U.S.C. 371 and claims the benefit of PCT Application No. PCT/EP2018/085616 having an international filing date of Dec. 18, 2018, which designated the U.S., which PCT application claimed the benefit of Europe Patent Application No. 18152786.2 filed Jan. 22, 2018, the disclosure of each of which are incorporated herein by reference.

TECHNICAL FIELD

The invention relates to an electronic lock with a slot antenna.

BACKGROUND

Locks and keys are evolving from the traditional pure mechanical locks. These days, electronic locks are becoming increasingly common. For electronic locks, electronic keys are used for authentication of a user. The user credentials (functioning as electronic keys) and electronic locks can communicate either over a wireless interface or a conductive interface. Such electronic locks and keys provide a number of benefits, including improved flexibility in management of access rights, audit trails, key management, etc.

When electronic locks communicate with user credentials over a wireless interface, the electronic lock needs to have an antenna. When the electronic lock is provided outside traditional housing, antennas can be provided with decent radio characteristics, as long as the lock is not provided e.g. in a metal door. However, such a solution is expensive, and difficult to install since the form factor is different than traditional mechanical locks.

Alternatively, the electronic lock can form part of a housing with the same form factor as a traditional mechanical lock, within a traditional housing. However, since the housing is often made of metal, the antenna is ineffective if provided inside the housing. Moreover, the electronic lock is often installed inside a metal door, which would then block radio signals.

External antennas outside the mechanical housing are cumbersome and add to cost and complexity.

JP H07 62940 A discloses a radio type electronic lock. US 2013/0241691 A1 discloses a non-contact electronic door locks having specialized radio frequency beam formation. GB 2 344 201 A discloses an apparatus for door entry control and/or door entry request indication.

SUMMARY

It is an object to provide an electronic lock with an antenna for wireless communication which provides a simpler and more secure installation.

According to a first aspect, it is provided an electronic lock for selectively locking a barrier to a surrounding structure. The electronic lock comprises: a locking bolt, a housing comprising metallic material, wherein the housing comprises a through-hole through which the locking bolt can pass; and a wireless communication module. The housing comprises a cut-out forming a slot antenna, wherein the wireless communication module is connected to the housing and thus the slot antenna. The slot antenna is formed on the same surface of the housing through which the locking bolt can pass.

The slot antenna may have a meandering shape.

The electronic lock may be configured to have a traditional form factor.

The effective length of the slot antenna may be about a quarter of a wavelength of radio signals intended to be transmitted or received using the antenna.

The electronic lock may further comprise a controller provided within the housing.

The wireless communication module may be provided within the housing.

The housing may be provided with a protective cover, at least on the side comprising the slot antenna.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Embodiments presented herein are based on the realisation that instead of providing a separate antenna element for wireless communication with electronic locks, the antenna function can be implemented by providing a slot antenna in the housing of the electronic lock. In this way, the structure and security of communication is improved, while providing an aesthetically pleasing design. Additionally, the electronic lock can in this way be provided within a traditional housing, allowing the electronic lock to be installed with minimal or no changes to surrounding structures.

Figure 1:
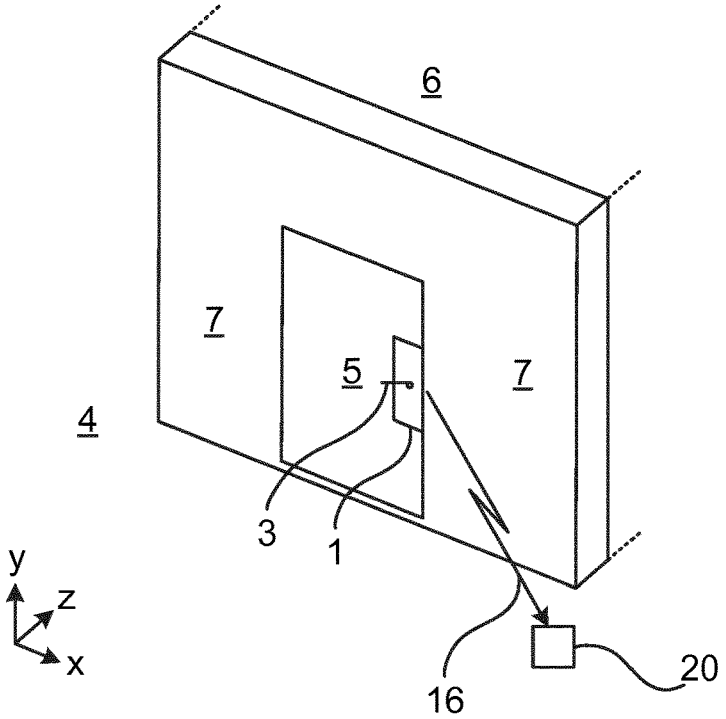
FIG. 1 is a schematic diagram showing an environment in which embodiments presented herein can be applied.

FIG. 1 is a schematic diagram showing an environment in which embodiments presented herein can be applied. Access to a physical space 6 is restricted by a physical barrier 5 which is selectively controlled to be in a locked state or an unlocked state. The physical barrier 5 can be a door, window, gate, hatch, cabinet door, drawer, etc., with a handle 3. The physical barrier 5 is provided in a surrounding physical structure 7 (being a wall, fence, ceiling, floor, etc.) and is provided between the restricted physical space 6 and an accessible physical space 4. It is to be noted that the accessible physical space 4 can be a restricted physical space in itself, but in relation to this physical barrier 5, the accessible physical space 4 is accessible.

In order to lock or unlock the barrier 5, an electronic lock 1 is provided. It is to be noted that the electronic lock 1 can be provided in the physical barrier 5 as shown or in the surrounding structure 7 (not shown).

Moreover, the electronic lock 1 comprises a user credential interface 16 for communicating with a user credential 20. The user credential interface 16 can be implemented using any suitable wireless interface, e.g. using Bluetooth, BLE, any of the IEEE 802.1 standards, RFID, Near Field Communication (NFC), any of the IEEE 802.11 standards, wireless USB, etc.

Optionally, the electronic lock 1 can connect with a gateway (not shown) to communicate with external entities, such as a central access control system provided in a remote location. This can also allow the electronic lock 1 to communicate with a remote control device (not shown), such as a smart phone, computer etc. for remote lock management. Using the remote communication, the electronic lock 1 is remotely controllable, e.g. to allow access for a particular user credential or to remotely unlock the electronic lock (e.g. for a tradesman, cleaner, child who have lost a key, etc.). Also, the remote communication enables event monitoring, e.g. of unlocking status, locking status, opening, closing, etc., which can be detected by the sensor device.

The user credential 20 can be implemented using any suitable device portable by a user and which can be used for authentication over the credential interface 16. The user credential 20 is typically carried or worn by the user and may be implemented as a mobile phone, a smartphone, a key fob, wearable device, smart phone case, access card, electronic physical key, etc.

Using the user credential interface 16, the authenticity of the user credential 20 can be checked by the electronic lock in an access control procedure, e.g. using a challenge and response scheme. The authorisation to open the electronic lock 1 is checked, either by the electronic lock 1 itself, or by communicating with an external (local or remote) authorisation device (not shown) to reach an access decision whether to grant or deny access.

Figure 2A:
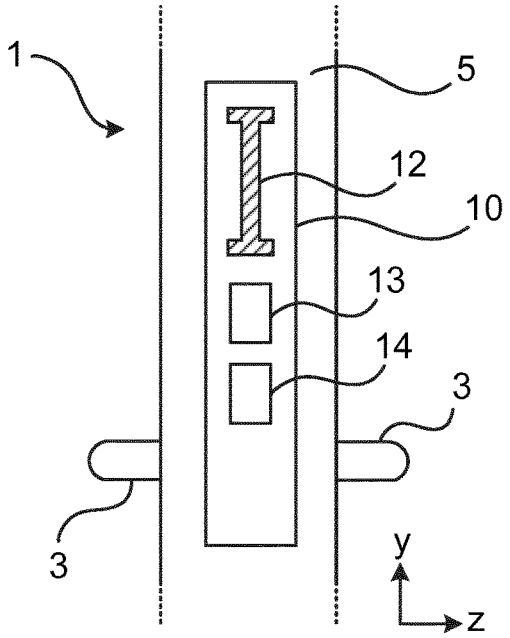
FIGS. 2A-B are schematic side views illustrating embodiments of the electronic lock of FIG. 1.
Figure 2B:
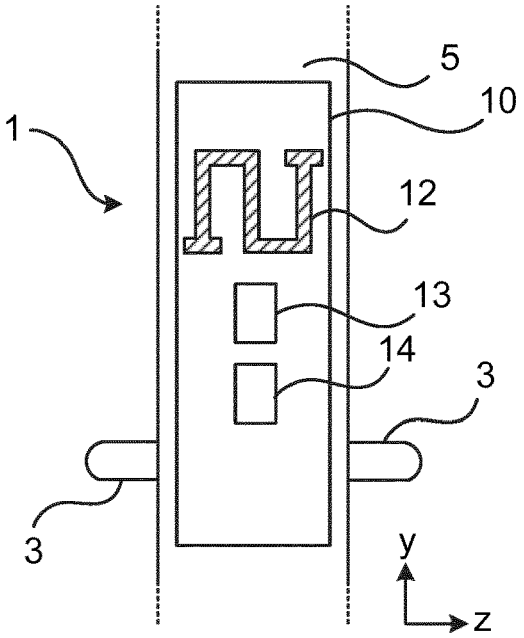

FIGS. 2A-B are schematic side views illustrating embodiments of the electronic lock 1 of FIG. 1. In this embodiment, the barrier is a door and the electronic lock 1 can be seen from the end of the door, where the electronic lock is provided in the door.

First, the embodiment illustrated in FIG. 2A will be described. The electronic lock 1 comprises a latch bolt 14 which latches closed when the barrier is pushed closed. The latch bolt 14 can be opened using the handle 3.

The locking function of the electronic lock 1 is provided using a locking bolt 13. In other words, the electronic lock 1 comprises a locking bolt 13 to control the locking. Using an access decision based on communication with a user credential, the electronic lock 1 determines whether to retract or extend the locking bolt 13 into the surrounding structure by sending an appropriate control signal to a motor (see 19 of FIG. 3) connected to the bolt 13.

For instance, when the locking bolt 13 is extended and the access decision is to grant access, the electronic lock 1 sends a control signal to the motor to retract the locking bolt 13 to thereby alter the state of the electronic lock 1 from locked to unlocked. When the locking bolt 13 is retracted and the access decision is to grant access, electronic lock 1 does not send any control signal to the electronic lock 1 to retract the locking bolt 13, since the locking bolt 13 is already retracted, i.e. the electronic lock is already in the unlocked state.

When the locking bolt is extended and the access decision is to deny access, the electronic lock 1 does not send any control signal to the electronic lock 1 to retract the locking bolt 13 since the state of the electronic lock 1 is already in the correct state, i.e. the locked state.

The communication with the user credential needs an antenna to work well. In embodiments presented herein the antenna is a slot antenna 12 which is formed by a cut-out in a housing 10 of the electronic lock. The housing 10 comprises metallic material, and can for instance be completely formed out of metal to withstand mechanical external attacks. The housing 10 comprises a through-hole through which the locking bolt 13 can pass.

The slot antenna 12 forms part of the housing. In particular, the slot antenna 12 is formed on the same surface of the housing 10 through which the locking bolt can pass, i.e. the same surface of the housing 10 as the through-hole through which the locking bolt can pass. In this way, the slot antenna is not exposed when the barrier is closed, since the surface containing the slot antenna faces a gap between the barrier and surrounding structure when the barrier is closed. Compared to providing an external antenna, this is more resistant to tampering, since the antenna it is much more difficult to sabotage the antenna. Additionally, the antenna is hidden from view most of the time, thus providing an aesthetically pleasing design. Furthermore, by the antenna forming part of the housing, installation is simpler and production cost is significantly lower compared to an external antenna. No additional weakening of the door due to the absence of extra holes for connecting an external antenna. Also, using the traditional form factor allows the electronic lock to be installed in structures (e.g. doors) made for traditional mechanical locks, allowing reuse of known building systems.

When BLE is used for communication, the 2.4 GHz frequency band is used, corresponding to a wavelength of 12.5 cm. The slot antenna can be about (within 3 mm or 1 mm of) a quarter of a wavelength long, i.e. 3.125 cm, which is a reasonable length to provide as a slot antenna in the housing.

Looking now to the embodiment of FIG. 2B, this is similar to the embodiment of FIG. 2A, and only differences will be mentioned here. In the embodiment of FIG. 2B, the slot antenna 12 has a meandering shape, to support larger wavelengths compared to a straight slot antenna.

Figure 3:
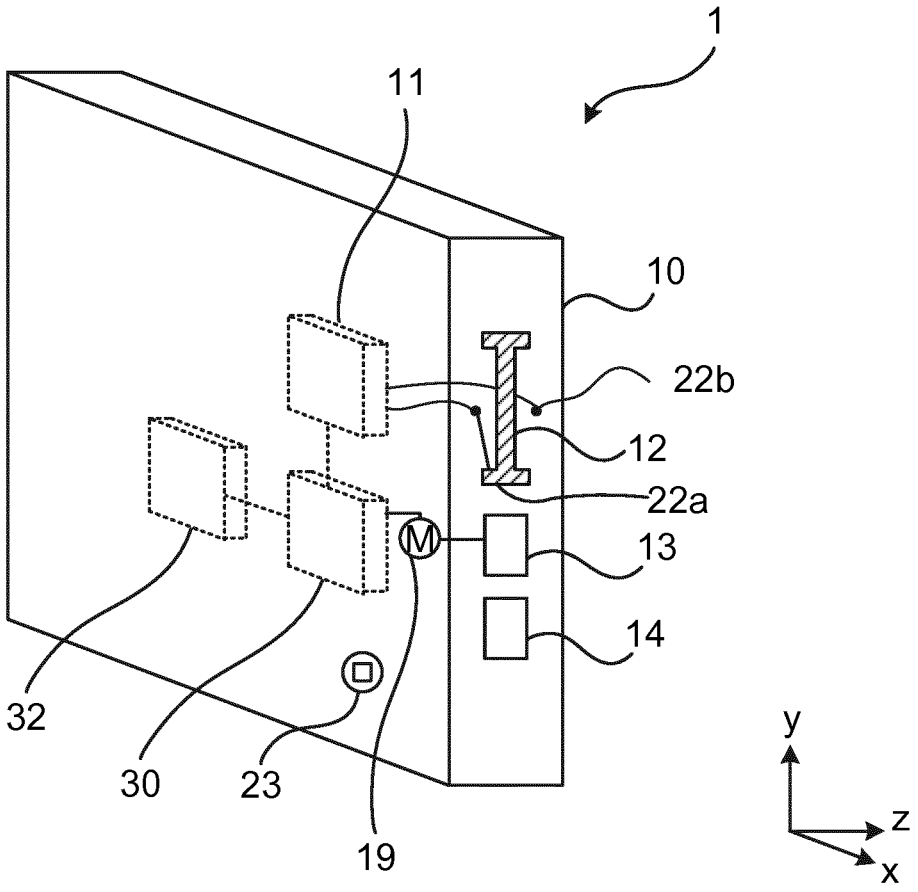
FIG. 3 is a schematic perspective view illustrating the electronic lock of FIG. 1 according to one embodiment.

FIG. 3 is a schematic perspective view illustrating the electronic lock of FIG. 1 according to one embodiment.

Here, a fitting 23 for the handle can be seen, which is mechanically coupled to the latch bolt 14. Moreover, internal components of the electronic lock 1 are schematically shown. A controller 30 is shown which controls the operation of the electronic lock 1. The controller 30 can be hardware based, e.g. using an Application Specific Integrated Circuit (ASIC), a Field Programmable Gate Array (FPGA), and/or discrete components. Alternatively or additionally, the controller 30 is software based, comprising a processor using any combination of one or more of a suitable central processing unit (CPU), microcontroller, digital signal processor (DSP), etc., capable of executing software instructions stored in a memory 32 accessible to the controller 30. The memory 32 can also store data, such as access control data used when evaluating whether a user credential is to gain access or not.

A wireless communication module 11 is connected to the controller 30 and comprises digital and analogue components for receiving data or transmitting data using the slot antenna 12.

The wireless communication module 11 is connected to two connection points 22*a-b* provided on the housing 10, to thereby utilise the slot antenna 12 for communication with external entities such as a user credential and/or a communication gateway.

Optionally, several of the mentioned components are combined in a single physical component.

The controller 30 is also connected to a motor 19 for extending or retracting the locking bolt 13.

The slot antenna 12 is directed towards a gap between the barrier and surrounding structure when the barrier is closed. In this way, communication to/from the antenna 12 can pass through the gap between the barrier 5 and the surrounding structure, even when the barrier is closed. This allows communication to occur efficiently, even in situations when one or both of the physical barrier 5 and the surrounding structure is made partly or completely of metal for increased security of the barrier per se.

The controller 30 is provided within the housing 10 and the wireless communication module 11 is provided within the housing. This increases the ability to withstand physical attacks to the controller 30 and/or wireless communication module 11. Furthermore, the housing 10 can be provided with a protective cover, at least on the side comprising the slot antenna 12. The protective cover can be a layer of protective material applied over the housing and over the slot antenna can e.g. be made of an epoxy material or other hard polymer. The protective covering prevents dust from entering the housing and also makes a physical attack to the electronic lock more difficult.

Here now follows a list of embodiments from another perspective, enumerated with roman numerals.

i. An electronic lock for selectively locking a barrier to a surrounding structure, the electronic lock comprising:
- a housing comprising metallic material; and
- a wireless communication module;
- wherein the housing comprises a cut-out forming a slot antenna, wherein the wireless communication module is connected to the housing and thus the slot antenna.

ii. The electronic lock according to embodiment i, wherein the slot antenna has a meandering shape.

iii. The electronic lock according to embodiment i or ii, wherein the slot antenna is directed towards an intended gap between the barrier and the surrounding structure when the barrier is closed.

iv. The electronic lock according to any one of the preceding embodiments, wherein the electronic lock is configured to be installed in the barrier.

v. The electronic lock according to any one of the preceding embodiments, wherein the effective length of the slot antenna is about a quarter of a wavelength of radio signals intended to be transmitted or received using the antenna.

vi. The electronic lock according to any one of the preceding embodiments, further comprising a controller provided within the housing.

vii. The electronic lock according to any one of the preceding embodiments, wherein the wireless communication module is provided within the housing.

viii. The electronic lock according to any one of the preceding embodiments, wherein the housing is provided with a protective cover, at least on the side comprising the slot antenna.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. An electronic lock for selectively locking a barrier to a surrounding structure, the electronic lock comprising:
- a locking bolt;
- a housing comprising metallic material, wherein the housing comprises a through-hole through which the locking bolt passes; and
- a wireless communication module contained within the housing;
- wherein the housing further comprises a cut-out forming a slot antenna, wherein the wireless communication module is connected to the housing and thus the slot antenna;
- wherein the slot antenna is formed on the same surface of the housing through which the locking bolt can pass.

2. The electronic lock according to claim 1, wherein the slot antenna has a meandering shape.

3. The electronic lock according to claim 1, wherein the electronic lock is configured to have a mechanical form factor.

4. The electronic lock according to claim 1, wherein the effective length of the slot antenna is about a quarter of a wavelength of radio signals intended to be transmitted or received using the antenna.

5. The electronic lock according to claim 1, further comprising a controller provided within the housing.

6. The electronic lock according to claim 5, further comprising memory provided within the housing, wherein the memory is connected to the controller and wherein the controller is connected to the wireless communication module.

7. The electronic lock according to claim 1, wherein the housing is provided with a protective cover, at least on the side comprising the slot antenna.

8. The electronic lock according to claim 6, wherein the wireless communication module is connected to two connection points provided on the housing to utilize the slot antenna.

9. The electronic lock according to claim 6, further comprising a motor that extends and retracts the locking bolt into and out of the through hole, wherein the motor is provided within the housing and is connected directly to the controller.

10. The electronic lock according to claim 6, wherein the memory stores access control data that is used by the controller to evaluate whether a user credential is to gain access through the barrier.

11. The electronic lock according to claim 5, wherein the housing encloses and protects the locking bolt, the wireless communication module, and the controller.

* * * * *